United States Patent [19]

Maestrelli

[11] Patent Number: 4,499,743

[45] Date of Patent: Feb. 19, 1985

[54] CLOTHING DRYCLEANING MACHINE

[75] Inventor: Gino Maestrelli, Milan. Italy

[73] Assignee: Maestrelli S.P.A., Milan, Italy

[21] Appl. No.: 537,044

[22] Filed: Sep. 29, 1983

[30] Foreign Application Priority Data

Oct. 8, 1982 [IT] Italy ..... 23683 A/82

[51] Int. Cl.[3] ..... D06F 43/08

[52] U.S. Cl. ..... 68/18 C; 68/18 R

[58] Field of Search ..... 68/18 R, 18 C; 34/77; 62/90, 173, 176.5

[56] References Cited

U.S. PATENT DOCUMENTS

| | | | |
|---|---|---|---|
| 2,111,618 | 3/1938 | Erbach | 62/173 |
| 2,418,239 | 4/1947 | Smith | 34/77 |
| 2,676,418 | 4/1954 | Shewmon | 34/77 |
| 2,961,844 | 11/1960 | McGrath | 62/173 |
| 3,119,239 | 1/1964 | Sylvan | 62/90 X |
| 3,738,117 | 6/1973 | Engel | 62/90 X |
| 4,154,003 | 5/1979 | Muller | 68/18 C |

FOREIGN PATENT DOCUMENTS

| | | | |
|---|---|---|---|
| 2069541 | 8/1981 | United Kingdom | 68/18 C |

*Primary Examiner*—Philip R. Coe
*Assistant Examiner*—Frankie L. Stinson
*Attorney, Agent, or Firm*—Wenderoth, Lind & Ponack

[57] ABSTRACT

A clothing drycleaning machine of the so-called closed circuit type, has a pneumatic circuit for the drying and solvent recovering air which is always closed on the drum wherein clothing articles to be cleaned are introduced. The circuit comprises at least one air circulation fan, at least one evaporator of a refrigerating equipment for cooling the air coming from the drum and condensing the solvent therein contained, and at least one condenser in the refrigerating equipment arranged downstream of the evaporator for heating the air to be recirculated in the drum. To obtain optimum conditions for energy yield and to emphasize the solvent recovery phase, at least one heat exchanger is provided to carry-out a heat exchange between air flows upstream and respectively downstream of the evaporator of the refrigerating equipment; further, the refrigerating equipment comprises means for controlling the heating efficiency of its condenser and/or the refrigerating efficiency of its evaporator depending on the desired air temperatures and flow rates during the drying and solvent recovering phases.

6 Claims, 1 Drawing Figure

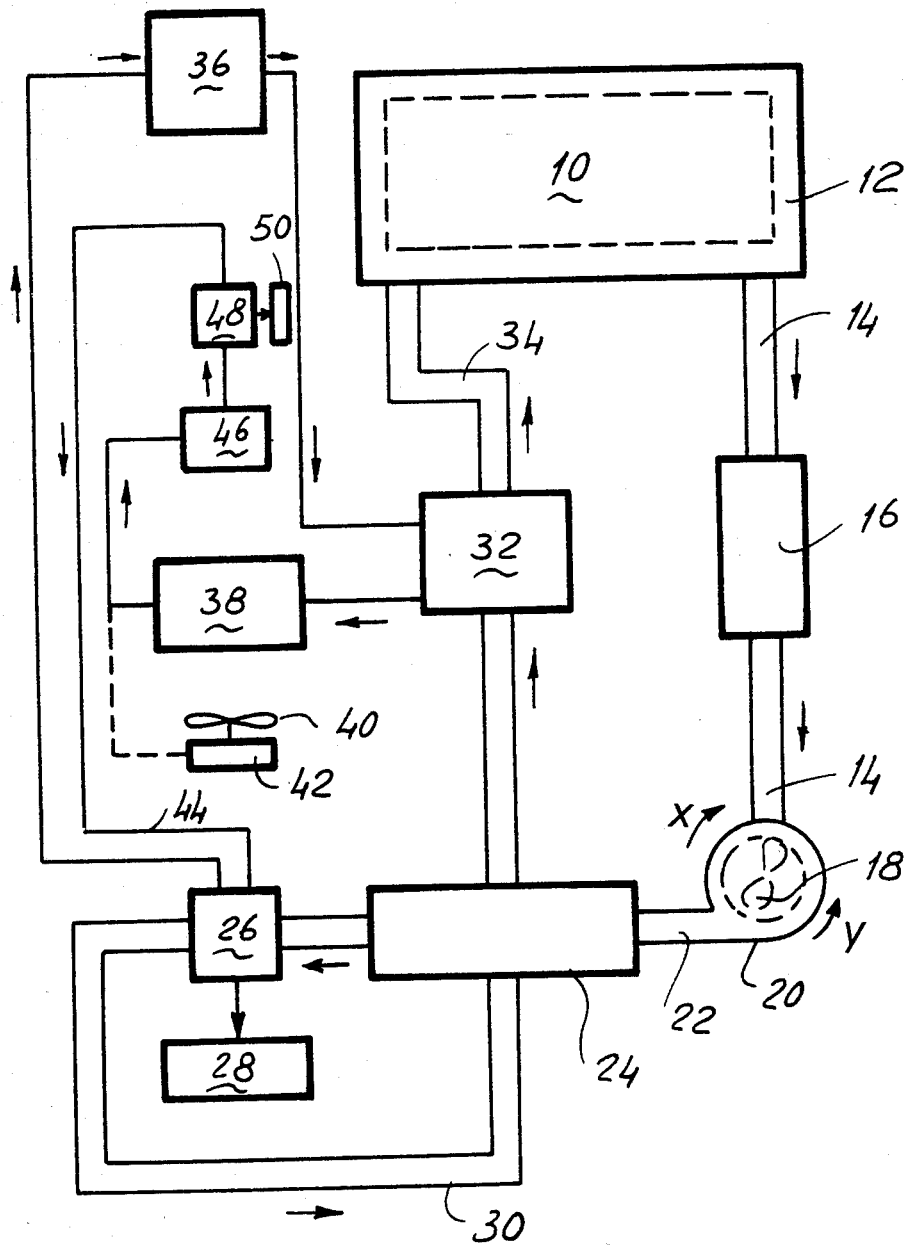
36
10
12
50
48
34
14
46
16
32
38
40
42
14
44
X
18
26
Y
20
22
28
24
30

CLOTHING DRYCLEANING MACHINE

BACKGROUND OF THE INVENTION

1. Field of the Invention

The present invention relates to a clothing drycleaning machine and more particularly it relates to the drying and solvent recovering circuit thereof, which is conceived in such a manner to obtain high energetic economy, simultaneously avoiding the solvent consumption and the pollution occurring in the known open circuit machines, nevertheless obtaining a solvent removal from the clothing similar to that obtained by using the above mentioned open circuit machines.

2. Description of the Prior Art

It is known that the drycleaning machines comprise a drying and solvent removal circuit, which, starting from the drum containing the clothing articles, comprises an air circulation fan, a condenser of the solvent contained in the air, and an element for heating said air before its re-introduction into the drum.

In conventional open circuit machines, a so-called deodorization phase follows the usual drying phase which is effected under a closed circuit condition and with a solvent recovery. In said deodorization phase, the above mentioned circuit is open to allow ambient air to enter the circuit and contact clothing, in order to remove residual solvent therefrom and to be finally discharged in the atmosphere.

This deodorization phase presents, however, various drawbacks and particularly the following ones:

- Solvent (Perchloroethylene) waste, as it is eliminated together with the deodorization air;
- Environment pollution caused by the discharged deodorization air;
- Requirement of a cleaner arranged at the outlet of the deodorization air.

To avoid said drawbacks, it has been already suggested to operate under closed circuit conditions by substituting the air deodorization phase with a more forced cooling of same air, in such a manner to obtain a higher solvent condensation and recovery degree. To this purpose, a condenser consisting of the evaporator of a refrigerating circuit is utilized, while the air flow rate is decreased during such forced cooling step, in such a manner to allow the desired temperature low levels to be reached.

Simultaneously with the refrigerating circuit evaporator, the condenser of same circuit is used to heat or to cooperate in heating the air during both drying and solvent recovery phases.

Said suggestion however has not resulted till now in a valid application, at least in connection with refrigerating equipment of the trade, as required by the market necessity. In fact, sufficiently emphasized air refrigerating and heating at the drum outlet and respectively inlet, particularly during the solvent removal (or recovery) have not been obtained.

In the embodiments till now known, not very high refrigerating levels (with a high solvent percentage remaining in the air) or low heating levels (the solvent in this case being not entirely removed from the clothing or even freezing thereon) have been compulsory accepted. In any case, the clothes still maintain a high solvent quantity at the end of removal or recovery operation, and this is a loss per se and can produce pollution and injury to operator's health during the ironing operation, when the residual solvent is released.

OBJECTS OF THE INVENTION

It is therefore an object of this invention to provide a clothing drycleaning machine of the so-called closed circuit type, which, in addition to allow a remarkable energy economy in respect of the conventional machines, is able to emphasize the solvent removal (or recovery) level - as it occurs when open circuit machines are utilized.

SUMMARY OF THE INVENTION

According to the invention, a machine of the so-called closed circuit type is provided, comprising a permanently closed pneumatic circuit for drying and solvent removing (or recovery) air, said circuit including the drum wherein clothes are contained and being provided with at least one air circulation fan, at least one evaporator of refrigerating equipment for cooling the air coming from the drum and condensing the solvent therein contained, and at least a condenser of said refrigerating equipment arranged downstream of said evaporator for heating the air to be recirculated in the drum, wherein at least one heat exchanger is arranged in said circuit to carry-out a heat exchange between the air flows upstream and respectively downstream said evaporator of the refrigerating equipment, and wherein means are provided in said refrigeration equipment for controlling its condenser heating efficiency and/or its evaporator cooling efficiency, depending on the required air temperatures and flow rates during the drying and solvent removing (or recovery) phases.

BRIEF DESCRIPTION OF THE DRAWINGS

The single FIGURE shows the circuit of the refrigerating and solvent removing (or recovery) air in a drycleaning machine according to the invention.

DESCRIPTION OF THE PREFERRED EMBODIMENT

With reference to the drawing, a drum 10, wherein drycleaned clothes are placed, is housed in a closed chamber 12, wherein air is circulated in such a manner that it penetrates through holes on the drum surface and removes the solvent from the already cleaned clothes. The air, loaded with solvent, is delivered through a duct 14 to a filtering unit 16 and then via a second duct 14 to a fan 18 which causes circulation. The fan rotates in the direction X within a shell 20. At the fan outlet, the air flow is delivered, by means of a duct 22, to a heat exchanger 24, for example, preferably of the tube or plate type, to obtain a pre-cooling thereof before entering a condenser 26, which is in the form of an evaporator of refrigerating equipment, the structure which will be hereinafter disclosed.

Due to air cooling in the evaporator 26, the same releases the sovlent vapors removed from the clothes in the druym 10, said vapors being then discharged in liquid form into a recovery tank 28 for their recycle. Downstream of the evaporator 26, the air is delivered, through a duct 30, to said heat exchanger 24, where it is pre-heated before entering a heating element 32 which also serves as a condenser of the above mentioned refrigerating equipment. At the outlet of said heating element 32, the heated air is delivered, through a duct 34, to the closed chamber 12 holding drum 10.

The refrigerating equipment is shown on the left of the drawing and the refrigerating fluid circulates in the direction of the arrow.

Downstream of the compressor 36, the refrigerating fluid enters the condenser 32 and therefrom a second condenser 38, arranged downstream from the first one, outside the air circuit and provided with its own refrigerating means. In this case, said refrigerating means consists of a fan 40 operated by a motor 42, which in turn is controlled by thermostatic control means (not shown) of the temperature at the outlet of the second condenser 38. Downstream of this second condenser 38, the refrigerating fluid is fed to a first expansion valve 46 and then to a second expansion valve 48, which can be connected or disconnected by thermostatic control means 50 according to the desired temperature conditions, said refrigerating liquid being then fed through line 44 to evaporator 26, from which it comes back to the compressor 36.

The operating conditions of a drycleaning machine designed according to the above outlined diagram are substantially as follows.

During the drying phase, the air is pre-cooled in the heat exchanger 24 and then cooled down to temperatures of the order of 0° C. The air is then pre-heated in the same heat exchanger 24 and then brought to temperatures of the order of 60° C. before entering the drum 10. The above operating conditions can be obtained also in known drycleaning machines having a closed circuit, but with a higher energy consumption, due to the absence of heat exchanger 24.

Further, as the known machines lack control of the operating conditions, in particular the heating conditions, too high temperatures within the drum 10 and then not sufficiently low temperatures within the evaporator 26 can be reached.

However, hereinafter is the following solvent removing (or recovery) phase which allows us to better distinguish the drycleaning machine according to this invention from those of the prior art. Note that the present machine allows us to reach the best working conditions. These conditions are reached above all by reducing the air flow rate in the circuit. This reduction can be obtained simply by rotating the fan 18 in a direction (Y) opposed to the rotational direction (X) during the drying phase, so to reach an air flow rate ratio of at least 1 : 3.5. Further, the cooling efficiency of evaporator 26 is improved by connecting the additional expansion valve 46 in line. This arrangement allows us to reach, together with the heat exchanger 24, air temperatures lower than −10° C. and of the order of −14° C. to −16° C. Notwithstanding these very low temperatures, never till now has there been reached in machines of this type, a relatively high temperature, not lower than 40° C., downstream of the condenser 32 and at the inlet of drum 10 with refrigerating equipment of a trade grade and with very reduced energy consumption.

As above said, achievement of relatively high temperatures in the drum 10 and very low temperatures in the evaporator 26 allows the operator to force the solvent removing (or recovery) phase until there is attained so low solvent residuals in the clothes that cannot be obtained in known drycleaning machines with a closed air circuit.

It is to be understood that, while a preferred embodiment of the invention has been described, many changes can be carried-out therein, without departing from the spirit and scope of the present invention.

I claim:

1. A clothing drycleaning machine of a closed circuit type comprising:

a permanently closed pneumatic circuit for drying and solvent removing (or recovery) air, a drum wherein clothes are contained, said drum having an inlet and being provided in said circuit;

at least one air circulation fan arranged in said circuit;

refrigerating fluid equipment connected in said circuit;

at least one evaporator in the refrigerating equipment for cooling the air coming from the drum and for condensing the solvent therein contained;

at least a first condenser in said refrigerating equipment arranged downstream from said evaporator for heating the air to be recirculated in the drum;

at least one heat exchanger arranged in said circuit to carry-out a heat exchange between the air flows upstream and respectively downstream said evaporator of the refrigerating equipment; and means, provided in said refrigerating equipment, for controlling heating efficiency of the condenser and/or cooling efficiency of the evaporator, depending on the required air temperatures and flow rates during the drying and solvent removing phases.

2. A drycleaning machine according to claim 1, wherein:

said means for controlling the heating efficiency of the first condenser obtain a minimum temperature at the inlet to the drum of 40° C. during the solvent removing phase.

3. A drycleaning machine according to claim 2, wherein said refrigerating fluid equipment includes:

a second condenser, series connected downstream from the first condenser and arranged outside the air circuit, means for cooling said second condenser, and a thermostatic control means which can be switched on or off at the outlet of the second condenser.

4. A drycleaning machine according to claim 1, wherein:

said at least one air circulation fan is capable of having its rotational direction reversed so that the air flow rate in said closed air circuit is reduced during the solvent removing (or recovery) phase, in respect of the flow rate during the drying phase, with a reduction ratio of at least 1:3.5.

5. A drycleaning machine according to claim 1, wherein:

said evaporator has an outlet at which the air temperature, during the solvent removing phase, does not rise above −10° C.

6. A drycleaning machine according to claim 1, wherein said controlling means includes:

two series connected expansion valves and control means for switching on one or both of said expansion valves.

* * * * *